United States Patent [19]

Chou et al.

[11] Patent Number: 4,761,177

[45] Date of Patent: Aug. 2, 1988

[54] PRODUCTION OF COBALT AND NICKEL POWDER

[75] Inventors: Eddie C. Chou; Leo W. Beckstead, both of Arvada, Colo.; Luther R. Tinnin, New Orleans, La.

[73] Assignee: AMAX Inc., Greenwich, Conn.

[21] Appl. No.: 66,437

[22] Filed: Jun. 26, 1987

[51] Int. Cl.[4] ..... C22B 23/04

[52] U.S. Cl. ..... 75/0.5 AA; 75/108; 75/119; 148/24; 148/105; 148/408; 148/409

[58] Field of Search ..... 75/0.5 A, 0.5 AA, 0.5, 75/108, 109, 119; 148/22, 24, 408, 409, 105

[56] References Cited

U.S. PATENT DOCUMENTS

| | | | |
|---|---|---|---|
| 2,796,343 | 6/1957 | Shaw et al. | 75/119 |
| 3,669,643 | 6/1972 | Bagley et al. | 75/108 |
| 4,096,316 | 6/1978 | Tamai et al. | 148/105 |
| 4,545,814 | 10/1985 | Chou et al. | 75/108 |

*Primary Examiner*—Robert L. Stoll

*Attorney, Agent, or Firm*—Michael A. Ciomek; Eugene J. Kalil

[57] ABSTRACT

Fine cobalt or nickel powder is produced by hydrogen reduction of a sulfate solution in the presence of a base and a strong reductant such as a metal borohydride wherein the base is added stagewise to the solution with the initial addition of base being sufficient to insure an essentially neutral pH at the time of reductant addition.

9 Claims, 1 Drawing Sheet

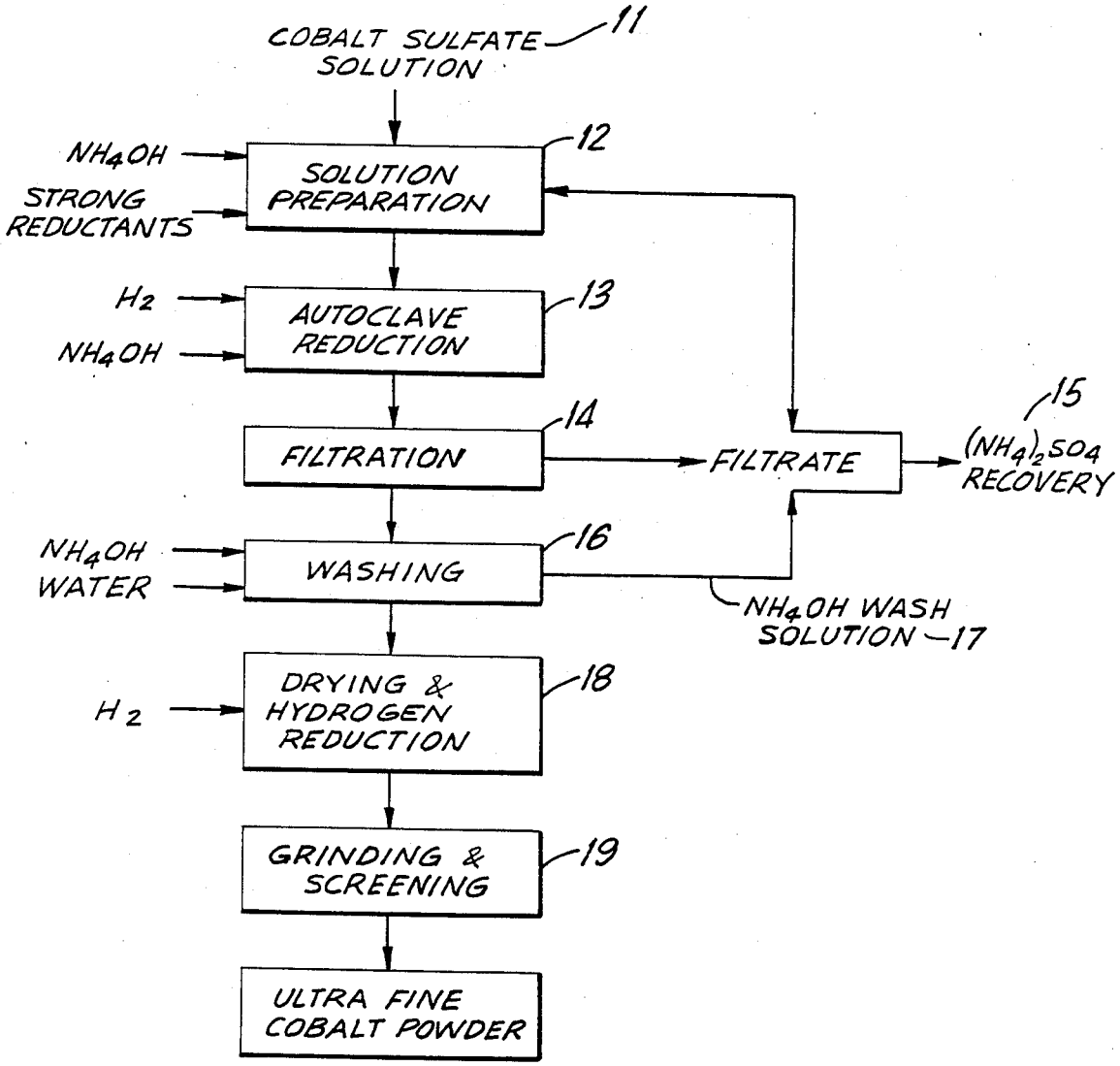
COBALT SULFATE SOLUTION
11
NH4OH
STRONG REDUCTANTS
SOLUTION PREPARATION
12
H2
NH4OH
AUTOCLAVE REDUCTION
13
FILTRATION
14
FILTRATE
15
(NH4)2SO4 RECOVERY
NH4OH
WATER
WASHING
16
NH4OH WASH SOLUTION
17
H2
DRYING & HYDROGEN REDUCTION
18
GRINDING & SCREENING
19
ULTRA FINE COBALT POWDER

PRODUCTION OF COBALT AND NICKEL POWDER

The present invention is directed to a hydrometallurgical method for producing fine cobalt and nickel powders, including ultrafine powders having a grain size of 2 micro-meters or even less and having properties which extend the usefulness of cobalt powder in powder metallurgy.

BACKGROUND OF THE INVENTION AND THE PRIOR ART

The production of nickel, cobalt and other metal powders by pressurized hydrogen reduction of aqueous ammoniacal sulfate solutions is a commercial practice pioneered by Sherritt Gordon Mines in Canada. In the process, it has been found that reduction kinetics are improved by the presence of particulate seed material such as fine nickel or cobalt powder. Such powders may come from many sources and may be introduced into the autoclave to act as nuclei for powder formation. U.S. Pat. No. 2,796,343 mentions the production of fine metal particles for use as seed by operations such as grinding of larger particles; precipitation by such reducing agents as hydrophosphite, hydrazine and the like which are stronger than hydrogen, decomposition of nickel carbonyl and the limited reduction of acidic solutions. U.S. Pat. Nos. 2,734,821, 2,796,342 and 2,796,343 describe "self-nucleating" solutions in which agents such as stannous, cerous, manganous, ferrous, titanous, vanadous and chromous salts are added.

U.S. Pat. No. 4,545,814 shows that strong reductants such as metal hydrides, metal borohydrides and metal borides promote reduction kinetics during the pressurized hydrogen reduction.

Known cobalt and nickel powders produced by the hydrogen reduction method are usually coarse, spherical powders since the usual practice is to repeatedly precipitate further metal upon the initially formed particles by further "densifications".

There are needs in the art for ultrafine powders, particularly of cobalt, for purposes such as cementing carbide tools. Such powders may have a grain size of 2 to 3 micro-meters (μm).

Present production methods used for such powders are shrouded in mystery, but are believed to entail solution of cobalt metal in hydrochloric acid, precipitation of the dissolved cobalt as cobalt oxalate or carbonate, filtration, washing, drying, decomposition to cobalt oxide and reduction to cobalt metal by hydrogen at elevated temperature. The resulting powder is then milled and screened and fractions of graded particle size are marketed. The method is complex and capital intensive.

Production of cobalt powder for use in cemented carbides requires much more than control of particle size. Particle morphology apparently is also important. Thus, in the production of hard metals, such as cobalt-cemented tungsten carbide, tungsten carbide powder of graded size between approximately 1 μm and 10 μm in particle size is blended with ultrafine cobalt powder, generally by ball milling with the addition of alcohol. The blended powder is mixed with a lubricant such as paraffin, dried and pressed to shape, dewaxed and presintered and then sintered at high temperature in a controlled protective atmosphere. The purpose of grinding tungsten carbide powder together with cobalt powder is to cover the surface of carbide particles evenly with cobalt. It is particularly important that the cobalt powder should be sufficiently uniform and finely dispersed to obviate the formation of cobalt agglomerates which may cause defects in the structure of the hard metal during sintering. Since the tungsten carbide powder is very fine grained (1 to 10 μm), the cobalt powder should be at least as fine grained as the carbide powder.

During hydrogen reduction of cobalt from a sulfate solution, sulfuric acid is generated. The amount of base added, such as ammonium hydroxide, sodium hydroxide or potassium hydroxide, should be sufficient to neutralize the acid generated, otherwise the reduction will not be complete.

$$CoSO_4 + H_2 \rightarrow Co^{\circ} + H_2SO_4$$

$$H_2SO_4 + 2NH_4OH \rightarrow (NH_4)_2SO_4 + 2H_2O$$

In U.S. Pat. No. 4,545,814, the Examples show that all ammonia required for acid neutralization was added to the sulfate solution initially, thereby producing a strongly ammoniacal solution, although the statement is made that ammonia can be added during the reduction stage.

The present invention resulted from close study of the reactions described in U.S. Pat. No. 4,545,814 and is directed to an improved process in which the reduction time is greatly decreased with minimal consumption of reagents and minimal sulfur contamination of the fine metal powder product.

BRIEF SUMMARY OF THE INVENTION

The invention is directed to an improvement in the production of cobalt and nickel powder by hydrogen reduction at an elevated temperature and pressure from an aqueous sulfate solution containing cobalt or nickel ions and a base, which may be ammonia or an alkali metal hydroxide, wherein a compound from the group consisting of metal hydrides, metal borohydrides and metal borides is employed as reductant, and wherein the required base is introduced stage-wise to the sulfate solution such that sufficient base is added initially to insure an essentially neutral pH at the time of reductant addition with the remaining base being introduced after reductant addition.

BRIEF DESCRIPTION OF THE DRAWING

The drawing comprises a flowsheet of the process as contemplated in accordance with the invention.

DETAILED DESCRIPTION OF THE INVENTION

The invention will first be described in reference to the drawing in which reference character 11 depicts the initial or starting sulfate solution which will generally contain about 30 to about 80 grams per liter of nickel or cobalt. The solution is prepared as at 12 by adding a strong reductant from the group consisting of metal hydrides, metal borohydrides and metal borides along with any necessary initial addition of a base, e.g., ammonia or an alkali metal hydroxide. Sufficient base is added to the solution prior to the reductant addition to render the solution essentially neutral, i.e., at a pH of about 5 to about 10, to avoid substantial precipitation of basic cobalt salts and to maintain the solution rich in metal ions. Also, decomposition and hydrolysis of the strong reductants in an acid medium is thereby avoided. The solution is pressurized with hydrogen and further ammonia is supplied either at 12 or at 13 to effectuate metal powder production. During hydrogen reduction, the autoclave is operated at a pressure of about 300 to about 700 pounds per square inch gage (psig) and at a temperature of about 90° to about 170° C. The reaction mass is filtered at 14. Desirably, the freshly precipitated metal powder is washed at 14 with an ammonia solution of about 0.5 to about 5 molar concentration to remove sulfur.

The fine cobalt powder produced from hydrogen reduction of a sulfate solution usually contains about 300 ppm sulfur. The high sulfur content is due to the entrainment of basic cobalt and/or $(NH_4)_2SO_4$ which is generated during the reduction.

$$CoSO_4+2NH_3+H_2 \rightarrow Co^{\circ}+(NH_4)_2SO_4$$

In order to reduce the entrained sulfur, a washing procedure using dilute ammonia solution was developed. The effective washing probably is due to the formation of highly soluble cobalt complex compounds. These compounds may have the general stoichiometry described below.

$$Co(NH_3)\times(H_2O)SO_4$$

where $x=1$ to 6.

The initial filtrate is transferred to ammonium sulfate recovery 15 while the ammonia wash solution 16 is recycled to 12. Of course, if sodium hydroxide or potassium hydroxide is employed as a base, the corresponding sulfate will report at 15. The washed powder is dried and hydrogen reduced at 18 and the product is ground and screened at 19.

It is difficult in a small-scale autoclave to introduce reactants during the course of the pressurized run on a continuous basis, even though this is desirable in accordance with the invention. Introduction of base under hydrogen pressure at a rate proportioned to acid generation is most desirable. This desired objective can be approximated by stage-wise introduction of ammonia or an alkali metal hydroxide, with no more than half the required ammonia being initially introduced and the remainder being introduced at 12 after reductant addition or during reduction in the autoclave during the run to the depressurized autoclave. Stagewise addition of base, as shown in the Examples hereinafter, is effective in reducing reaction time and in producing fine metal powder.

Examples will now be given.

EXAMPLE 1

The effect of ammonium hydroxide addition on the reduction of cobalt from cobalt sulfate solutions was studied. The results are presented in the following table.

| Test No. | $NH_4OH$ Addition | Reduction Time, min. | Product Density, g/cc | Product Grain Size, um |
|---|---|---|---|---|
| 1 | Single Stage | 43 | 1.03 | 20 |
| 2 | Single Stage | 38 | 1.01 | 20 |
| 3 | Two Stage | 17 | 0.52 | 1 |
| 4 | Two Stage | 16 | 0.55 | 1 |

In tests 1 and 2, the feed solution, containing 60 gpl Co, was purged with inert gas for 10 minutes at ambient temperature. A predetermined amount of $NH_4OH$ sufficient to neutralize the acid generated during reduction and sodium borohydride were added in that order to the cobalt sulfate solution. The solution was heated to 155° C. and then subjected to hydrogen reduction at 600 psig total pressure. When hydrogen consumption ceased, the reduction was complete. After depressurizing the reactor, the resulting cobalt slurry was filtered, washed, and dried. Similar procedures were used in tests 3 and 4, except that only one-half of the required $NH_4OH$ solution was added prior to the addition of sodium borohydride. After 10 minutes of mixing, the balance of the required $NH_4OH$ was added to the cobalt sulfate solution. In all four tests, the recovery of cobalt was about 99 percent. However, the two-stage ammonium hydroxide addition method resulted in more rapid reduction and generated less dense and finer cobalt powders when compared to the single-stage ammonium hydroxide addition method.

EXAMPLE 2

The effect of ammonium hydroxide addition on the reduction of cobalt sulfate solutions was further examined by changing the amount of ammonium hydroxide addition in the first and second stage additions. Results are presented in the following table.

| Test No. | $NH_4OH$ Addition 1st/2nd Stage | Product Density, g/cc | Product Grain Size, um |
|---|---|---|---|
| 5 | 25%/75%* | 0.32 | 1 |
| 6 | 50%/50% | 0.48 | 1 |
| 7 | 75%/25% | 0.49 | 1 |

*% stands for the percentage of $NH_4OH$ required to neutralize the acid generated during the cobalt reduction. $CoSO_4 + H_2 \rightarrow Co^{\circ} + H_2SO_4$ The procedures used, as described for tests 3 and 4 above, were used here, except that the amount of ammonium hydroxide added in the first and second stages was varied. In all three tests, the recovery of cobalt was about 94 percent within the reduction time of 12 minutes. It appears that less dense cobalt powder was produced when the amount of the required $NH_4OH$ solution added in the first stage addition was less than the amount added in the second stage.

EXAMPLE 3

The effect of ammonium hydroxide washing on the sulfur content in the dry cobalt powder produced by autoclave hydrogen reduction of cobalt sulfate solutions and subsequent filtration, multiple stage water washing, and drying was investigated. The ammonium hydroxide washing tests were conducted by stirring 50 grams of dry cobalt powder in 500 ml of lixiviant for 1 hour at 70° C. The slurries were then filtered and washed twice with 100 ml of deionized water each time. The washed powder was dried and analyzed. Test results are presented in the following table.

| Sample Description | Sulfur in Cobalt, ppm |
|---|---|
| Cobalt Powder Before Washing | 240 |
| Water Washed | 200 |
| 1 M $NH_4OH$ Washed | 70 |
| 5 M $NH_4OH$ Washed | 50 |

EXAMPLE 4

To obtain optimum sulfur removal, the ammonium hydroxide wash should be conducted with freshly precipitated cobalt powder from the autoclave hydrogen reduction stage, instead of washing the powder after water washing and drying, as tested in Example 3. Test results showed that washing freshly precipitated powder in $NH_4OH$ solution produced powder containing only 20 ppm sulfur.

It is known that cobalt solutions containing an $NH_3/Co^{++}$ molar ratio of 1.5 to 5 precipitate a blue basic cobalt salt at both ambient and elevated temperatures. The presence of $(NH_4)_2SO_4$ increases the solubility of this basic cobalt salt. If a feed solution is low in $(NH_4)_2SO_4$, the addition of ammonia all-at-once to obtain an $NH_3/Co^{++}$ molar ratio of 2 would generate a cobalt slurry containing very little soluble cobalt. In order to enhance the formation of amorphous precipitates by contacting a cobalt sulfate solution with metal hydrides, metal borohydrides, or metal borides, it is important to maintain the cobalt feed solution rich in $Co^{++}$ at a neutral pH prior to the addition of the strong reductants. By maintaining a neutral pH, the decomposition and hydrolysis of these strong reductants in an acid medium is minimized. For satisfying both requirements described above, a stage-wise base, e.g., ammonia, addition method is effective.

In tests similar to those already described, sodium hydroxide was substituted for ammonium hydroxide. Cobalt powder with particles in the size range of 2 to 10 micrometers was produced.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. In the process for producing fine cobalt powder by pressurized hydrogen reduction from cobalt sulfate solution using a strong reductant from the group consisting of metal hydrides, metal borohydrides and metal borides and using a base to neutralize the acid generated during hydrogen reduction the improvement which comprises introducing said base into said solution in stages such that no more than about one-half the required amount of said base is added to said solution along with or prior to addition of said reductant with the remaining required amount of base being introduced after the addition of said reductant.

2. The process in accordance with claim 1 wherein said base is selected from the group consisting of ammonia and alkali metal hydroxides.

3. The process in accordance with claim 1 wherein said base is ammonia.

4. The process in accordance with claim 1 wherein sufficient base is introduced into said solution to provide an essentially neutral pH therein at the time of reductant addition and the remaining base is introduced at substantially the rate required to neutralize said acid as said acid is generated.

5. The process in accordance with claim 1 wherein the cobalt powder resulting from said hydrogen reduction is separated and washed with ammonia solution to remove sulfur.

6. The process in accordance with claim 4 wherein said cobalt powder is freshly precipitated.

7. In the process for producing fine metal powder from the group consisting of cobalt and nickel by pressurized hydrogen reduction of a sulfate solution using a strong reductant from the group consisting of metal hydrides, metal borohydrides and metal borides and a base to neutralize the acid generated during said hydrogen reduction, the improvements comprising introducing said base stage-wise into said solution during said reduction with sufficient base being introduced into said solution to provide an essentially neutral pH therein at the time of reductant addition, with the remaining base being introduced after reductant addition, separating metal powder resulting from said pressurized hydrogen reduction and washing said freshly precipitated metal powder with an ammonia solution to remove sulfur.

8. The process in accordance with claim 7 wherein said base is selected from the group consisting of ammonia and alkali metal hydroxides.

9. The process in accordance with claim 7 wherein said base is ammonia.

* * * * *